US009514611B2

(12) United States Patent
Caputo et al.

(10) Patent No.: US 9,514,611 B2
(45) Date of Patent: Dec. 6, 2016

(54) GAMING SYSTEM AND METHOD FOR PROVIDING A GAME WITH UNLOCKABLE FEATURES

(71) Applicant: IGT, Las Vegas, NV (US)

(72) Inventors: Scott A. Caputo, Santa Clara, CA (US); Jon M. Leupp, Orinda, CA (US)

(73) Assignee: IGT, Las Vegas, NV (US)

( * ) Notice: Subject to any disclaimer, the term of this patent is extended or adjusted under 35 U.S.C. 154(b) by 344 days.

(21) Appl. No.: 14/195,445

(22) Filed: Mar. 3, 2014

(65) Prior Publication Data

US 2014/0256403 A1 Sep. 11, 2014

Related U.S. Application Data

(60) Provisional application No. 61/773,684, filed on Mar. 6, 2013.

(51) Int. Cl.
*A63F 9/24* (2006.01)
*G07F 17/32* (2006.01)

(52) U.S. Cl.
CPC ..... *G07F 17/3267* (2013.01); *G07F 17/32* (2013.01); *G07F 17/326* (2013.01); *G07F 17/3258* (2013.01)

(58) Field of Classification Search
CPC ..... A63F 17/32; A63F 17/3258; G07F 17/32; G07F 17/3258
USPC ..... 463/16, 20, 42
See application file for complete search history.

(56) References Cited

U.S. PATENT DOCUMENTS

| | | | |
|---|---|---|---|
| 3,048,402 | A | 5/1961 | Schaper |
| 3,545,758 | A | 12/1970 | Payne, Jr. |
| 4,285,521 | A | 8/1981 | Joel, III |
| 4,327,919 | A | 5/1982 | Vennor |
| 4,342,454 | A | 8/1982 | Baer et al. |
| 4,413,828 | A | 11/1983 | Gardner |
| 4,488,727 | A | 12/1984 | Lam |
| 4,575,622 | A | 3/1986 | Pellegrini |
| 4,582,324 | A | 4/1986 | Koza et al. |
| 4,657,254 | A | 4/1987 | Renner |
| 4,695,053 | A | 9/1987 | Vazquez, Jr. et al. |
| 4,738,451 | A | 4/1988 | Logg |
| 4,752,068 | A | 6/1988 | Endo |
| 4,764,666 | A | 8/1988 | Bergeron |
| 4,805,907 | A | 2/1989 | Hagiwara |
| 4,856,787 | A | 8/1989 | Itkis |

(Continued)

FOREIGN PATENT DOCUMENTS

| | | |
|---|---|---|
| AU | 718243 | 4/2000 |
| EP | 0360613 | 9/1989 |

(Continued)

*Primary Examiner* — Jason Skaarup
*Assistant Examiner* — Ryan Hsu
(74) *Attorney, Agent, or Firm* — Neal, Gerber & Eisenberg LLP

(57) ABSTRACT

In various embodiments, the present disclosure relates generally to gaming systems and methods for providing unlockable features and/or unlockable content. In such embodiments, the gaming system includes a plurality of initially unlocked features or content and a plurality of initially locked features or content, wherein as the player advances or progresses during the play of one or more games, zero, one or more previously locked features or content become unlocked.

24 Claims, 5 Drawing Sheets

(56) References Cited

U.S. PATENT DOCUMENTS

| | | | |
|---|---|---|---|
| 4,858,930 | A | 8/1989 | Sato |
| 4,882,473 | A | 11/1989 | Bergeron et al. |
| 4,926,327 | A | 5/1990 | Sidley |
| 4,948,138 | A | 8/1990 | Pease et al. |
| 5,014,982 | A | 5/1991 | Okada et al. |
| 5,018,736 | A | 5/1991 | Pearson et al. |
| 5,034,807 | A | 7/1991 | Von Kohorn |
| 5,159,549 | A | 10/1992 | Hallman et al. |
| 5,179,517 | A | 1/1993 | Sarbin et al. |
| 5,242,163 | A | 9/1993 | Fulton |
| 5,265,874 | A | 11/1993 | Dickinson et al. |
| 5,292,127 | A | 3/1994 | Kelly et al. |
| 5,321,241 | A | 6/1994 | Craine |
| 5,333,868 | A | 8/1994 | Goldfarb |
| 5,342,047 | A | 8/1994 | Heidel et al. |
| 5,342,049 | A | 8/1994 | Wichinsky et al. |
| 5,351,970 | A | 10/1994 | Fioretti |
| 5,370,306 | A | 12/1994 | Schulze et al. |
| 5,370,399 | A | 12/1994 | Liverance |
| 5,393,057 | A | 2/1995 | Marnell, II |
| 5,429,361 | A | 7/1995 | Raven et al. |
| 5,470,079 | A | 11/1995 | LeStrange et al. |
| 5,533,727 | A | 7/1996 | DeMar |
| 5,547,202 | A | 8/1996 | Tsumura |
| 5,551,692 | A | 9/1996 | Pettit et al. |
| 5,560,603 | A | 10/1996 | Seelig et al. |
| 5,575,474 | A | 11/1996 | Rossides |
| 5,580,053 | A | 12/1996 | Crouch |
| 5,580,308 | A | 12/1996 | Nakamura |
| 5,580,309 | A | 12/1996 | Piechowiak et al. |
| 5,586,766 | A | 12/1996 | Forte et al. |
| 5,586,936 | A | 12/1996 | Bennett et al. |
| 5,609,525 | A | 3/1997 | Ohno et al. |
| 5,655,961 | A | 8/1997 | Acres et al. |
| 5,664,998 | A | 9/1997 | Seelig et al. |
| 5,674,128 | A | 10/1997 | Holch et al. |
| 5,702,304 | A | 12/1997 | Acres et al. |
| 5,720,663 | A | 2/1998 | Nakatani et al. |
| 5,741,183 | A | 4/1998 | Acres et al. |
| 5,743,523 | A | 4/1998 | Kelly et al. |
| 5,743,800 | A | 4/1998 | Huard et al. |
| 5,752,882 | A | 5/1998 | Acres et al. |
| 5,761,647 | A | 6/1998 | Boushy |
| 5,769,716 | A | 6/1998 | Saffari et al. |
| 5,770,533 | A | 6/1998 | Franchi |
| 5,772,512 | A | 6/1998 | Chichester |
| 5,779,544 | A | 7/1998 | Seelig et al. |
| 5,779,549 | A | 7/1998 | Walker et al. |
| 5,806,045 | A | 9/1998 | Biorge et al. |
| 5,816,918 | A | 10/1998 | Kelly et al. |
| 5,820,459 | A | 10/1998 | Acres et al. |
| 5,820,460 | A | 10/1998 | Fulton |
| 5,833,536 | A | 11/1998 | Davids et al. |
| 5,833,537 | A | 11/1998 | Barrie |
| 5,833,540 | A | 11/1998 | Miodunski et al. |
| 5,836,817 | A | 11/1998 | Acres et al. |
| 5,851,148 | A | 12/1998 | Brune et al. |
| 5,876,284 | A | 3/1999 | Acres et al. |
| 5,882,258 | A | 3/1999 | Kelly et al. |
| 5,890,962 | A | 4/1999 | Takemoto |
| 5,902,983 | A | 5/1999 | Crevelt et al. |
| 5,911,418 | A | 6/1999 | Adams |
| 5,919,091 | A | 7/1999 | Bell et al. |
| 5,931,467 | A | 8/1999 | Kamille |
| 5,944,314 | A | 8/1999 | Stavinsky |
| 5,947,820 | A | 9/1999 | Morro et al. |
| 5,951,397 | A | 9/1999 | Dickinson |
| 5,957,775 | A | 9/1999 | Cherry |
| 5,971,849 | A | 10/1999 | Falciglia |
| 5,983,196 | A | 11/1999 | Wendkos |
| 5,997,401 | A | 12/1999 | Crawford |
| 6,004,211 | A | 12/1999 | Brenner et al. |
| 6,007,426 | A | 12/1999 | Kelly et al. |
| 6,007,427 | A | 12/1999 | Wiener et al. |
| 6,009,412 | A | 12/1999 | Storey |
| 6,012,045 | A | 1/2000 | Barzilai et al. |
| 6,012,982 | A | 1/2000 | Piechowiak et al. |
| 6,012,983 | A | 1/2000 | Walker et al. |
| 6,015,344 | A | 1/2000 | Kelly et al. |
| 6,015,346 | A | 1/2000 | Bennett |
| 6,024,643 | A | 2/2000 | Begis |
| 6,033,307 | A | 3/2000 | Vancura |
| 6,039,648 | A | 3/2000 | Guinn et al. |
| 6,048,269 | A | 4/2000 | Burns et al. |
| 6,050,895 | A | 4/2000 | Luciano et al. |
| 6,061,660 | A | 5/2000 | Eggleston et al. |
| 6,068,552 | A | 5/2000 | Walker et al. |
| 6,068,553 | A | 5/2000 | Parker |
| 6,077,163 | A | 6/2000 | Walker et al. |
| 6,089,976 | A | 7/2000 | Schneider |
| 6,102,798 | A | 8/2000 | Bennett |
| 6,110,041 | A | 8/2000 | Walker et al. |
| 6,113,098 | A | 9/2000 | Adams |
| 6,113,493 | A | 9/2000 | Walker et al. |
| 6,126,542 | A | 10/2000 | Fier |
| 6,135,885 | A | 10/2000 | Lermusiaux |
| 6,142,872 | A | 11/2000 | Walker et al. |
| 6,146,273 | A | 11/2000 | Olsen |
| 6,159,098 | A | 12/2000 | Slomiany et al. |
| 6,162,122 | A | 12/2000 | Acres et al. |
| 6,164,652 | A | 12/2000 | Lauretta et al. |
| 6,165,071 | A | 12/2000 | Weiss |
| 6,174,235 | B1 | 1/2001 | Walker et al. |
| 6,178,408 | B1 | 1/2001 | Copple et al. |
| 6,179,710 | B1 | 1/2001 | Sawyer et al. |
| 6,190,255 | B1 | 2/2001 | Thomas et al. |
| 6,193,606 | B1 | 2/2001 | Walker et al. |
| 6,193,607 | B1 | 2/2001 | Kay |
| 6,193,608 | B1 | 2/2001 | Walker et al. |
| 6,203,429 | B1 | 3/2001 | Demar et al. |
| 6,203,430 | B1 | 3/2001 | Walker et al. |
| 6,210,275 | B1 | 4/2001 | Olsen |
| 6,210,279 | B1 | 4/2001 | Dickinson |
| 6,227,969 | B1 | 5/2001 | Yoseloff |
| 6,227,972 | B1 | 5/2001 | Walker et al. |
| 6,231,445 | B1 | 5/2001 | Acres |
| 6,234,896 | B1 | 5/2001 | Walker et al. |
| 6,234,897 | B1 | 5/2001 | Frohm et al. |
| 6,244,958 | B1 | 6/2001 | Acres |
| 6,251,014 | B1 | 6/2001 | Stockdale et al. |
| 6,254,481 | B1 | 7/2001 | Jaffe |
| 6,254,483 | B1 | 7/2001 | Acres |
| 6,267,669 | B1 | 7/2001 | Luciano, Jr. et al. |
| 6,273,820 | B1 | 8/2001 | Haste, III |
| 6,280,326 | B1 | 8/2001 | Saunders |
| 6,293,866 | B1 | 9/2001 | Walker et al. |
| 6,302,790 | B1 | 10/2001 | Brossard |
| 6,302,793 | B1 | 10/2001 | Fertitta, III et al. |
| 6,311,976 | B1 | 11/2001 | Yoseloff et al. |
| 6,312,334 | B1 | 11/2001 | Yoseloff |
| 6,319,127 | B1 | 11/2001 | Walker et al. |
| 6,334,613 | B1 | 1/2002 | Yoseloff |
| 6,340,331 | B1 | 1/2002 | Saunders et al. |
| 6,364,765 | B1 | 4/2002 | Walker et al. |
| 6,364,766 | B1 | 4/2002 | Anderson et al. |
| 6,365,765 | B1 | 4/2002 | Baldwin et al. |
| 6,371,852 | B1 | 4/2002 | Acres |
| 6,386,974 | B1 | 5/2002 | Adams |
| 6,394,900 | B1 | 5/2002 | McGlone et al. |
| 6,394,907 | B1 | 5/2002 | Rowe |
| 6,398,218 | B1 | 6/2002 | Vancura |
| 6,398,650 | B1 | 6/2002 | Horigami et al. |
| 6,406,369 | B1 | 6/2002 | Baerlocher et al. |
| 6,431,983 | B2 | 8/2002 | Acres |
| 6,443,452 | B1 | 9/2002 | Brune |
| 6,506,117 | B2 | 1/2003 | DeMar et al. |
| 6,506,118 | B1 | 1/2003 | Baerlocher et al. |
| 6,533,273 | B2 | 3/2003 | Cole et al. |
| 6,540,609 | B1 | 4/2003 | Paige |
| 6,592,456 | B2 | 7/2003 | Walker et al. |
| 6,592,457 | B1 | 7/2003 | Frohm et al. |
| 6,605,001 | B1 | 8/2003 | Tarantino |
| 6,609,975 | B1 | 8/2003 | Sawyer et al. |
| 6,612,575 | B1 | 9/2003 | Cole et al. |

(56) References Cited

U.S. PATENT DOCUMENTS 6,648,759 B2 11/2003 Vancura
6,663,489 B2 12/2003 Baerlocher
6,682,421 B1 1/2004 Rowe et al.
6,722,981 B2 4/2004 Kaminkow et al.
6,722,985 B2 4/2004 Criss-Puszkiewicz et al.
6,726,562 B2 4/2004 Vancura
6,745,236 B1 6/2004 Hawkins et al.
6,752,312 B1 6/2004 Chamberlain et al.
6,758,757 B2 7/2004 Luciano, Jr. et al.
6,761,633 B2 7/2004 Riendeau et al.
6,776,713 B2 8/2004 Gauselmann
6,780,111 B2 8/2004 Cannon et al.
6,793,575 B2 9/2004 Brown et al.
6,800,027 B2 10/2004 Giobbi et al.
6,811,486 B1 11/2004 Luciano, Jr.
6,840,860 B1 1/2005 Okuniewicz
6,902,478 B2 6/2005 McClintic
6,923,721 B2 8/2005 Luciano et al.
6,955,600 B2 10/2005 Glavich et al.
6,986,711 B2 1/2006 Vancura
7,037,192 B2 5/2006 Baerlocher et al.
7,052,395 B2 5/2006 Glavich et al.
7,066,814 B2 6/2006 Glavich et al.
7,094,148 B2 8/2006 Baerlocher et al.
7,121,942 B2 10/2006 Baerlocher
7,182,690 B2 2/2007 Giobbi et al.
7,235,011 B2 6/2007 Randall et al.
7,258,611 B2 8/2007 Bigelow, Jr. et al.
7,275,990 B2 10/2007 Walker et al.
7,281,981 B2 10/2007 Yotoriyama
7,381,134 B2 6/2008 Cuddy et al.
7,473,174 B2 1/2009 Cuddy et al.
7,513,826 B2 4/2009 Cuddy
7,572,183 B2 8/2009 Olivas et al.
7,666,083 B2 2/2010 Baerlocher et al.
7,674,180 B2 3/2010 Graham et al.
7,682,244 B1 3/2010 Luciano, Jr. et al.
7,682,246 B2 3/2010 Cregan et al.
7,690,982 B2 4/2010 Cuddy
7,740,533 B2 6/2010 Walker et al.
7,789,755 B2 9/2010 Davis et al.
7,883,403 B2 2/2011 Low et al.
7,883,406 B2 2/2011 Vancura
7,927,206 B2 4/2011 Baerlocher et al.
8,002,620 B2 8/2011 Nicely et al.
8,033,903 B2 10/2011 Cregan
8,092,302 B2 1/2012 Cuddy et al.
8,113,942 B2 2/2012 Hoffman et al.
8,142,274 B2 3/2012 Baerlocher
8,152,630 B2 4/2012 Cohen
8,162,745 B2 4/2012 Jaffe et al.
8,216,062 B2 7/2012 Baerlocher et al.
8,221,226 B2 7/2012 Baerlocher et al.
8,231,456 B2 7/2012 Zielinski
8,241,108 B2 8/2012 Belger et al.
8,246,449 B2 8/2012 Baerlocher et al.
8,251,798 B2 8/2012 Belger et al.
8,262,455 B2 9/2012 Caputo et al.
8,267,773 B2 9/2012 Jaffe et al.
8,272,940 B2 9/2012 Cuddy et al.
8,277,305 B2 10/2012 Caputo et al.
8,353,755 B2 1/2013 Vann et al.
8,376,836 B2 2/2013 Baerlocher et al.
8,382,572 B2 2/2013 Hoffman et al.
8,425,303 B2 4/2013 Kennedy et al.
8,449,378 B2 5/2013 Michaelson et al.
8,480,475 B2 7/2013 Adiraju et al.
8,506,388 B2 8/2013 Walker et al.
8,517,818 B2 8/2013 Nicely et al.
8,550,920 B1 10/2013 Allen et al.
8,628,422 B2 1/2014 Allen et al.
2001/0024971 A1 9/2001 Brossard
2001/0046893 A1 11/2001 Giobbi et al.
2001/0048193 A1 12/2001 Yoseloff et al.
2002/0028708 A1 3/2002 Busch et al.
2002/0039919 A1 4/2002 Joshi et al.
2002/0074726 A1 6/2002 Yoseloff et al.
2002/0077170 A1 6/2002 Johnson et al.
2002/0077173 A1 6/2002 Luciano et al.
2002/0077174 A1 6/2002 Luciano et al.
2002/0077180 A1* 6/2002 Swanberg ..... A63F 13/10 463/43
2002/0082071 A1 6/2002 Riendeau et al.
2002/0093136 A1 7/2002 Moody
2002/0094871 A1 7/2002 Luciano, Jr. et al.
2002/0107065 A1 8/2002 Rowe
2002/0151349 A1 10/2002 Joshi
2002/0196342 A1 12/2002 Walker et al.
2003/0013515 A1 1/2003 Rowe et al.
2003/0013531 A1 1/2003 Rowe et al.
2003/0036422 A1 2/2003 Baerlocher et al.
2003/0036427 A1 2/2003 Brandstetter et al.
2003/0064779 A1 4/2003 Suda
2003/0064794 A1 4/2003 Mead et al.
2003/0078101 A1 4/2003 Schneider et al.
2003/0100362 A1 5/2003 Horniak et al.
2003/0106769 A1 6/2003 Weiss
2003/0114218 A1 6/2003 McClintic
2003/0114219 A1 6/2003 McClintic
2003/0119579 A1 6/2003 Walker et al.
2003/0157979 A1 8/2003 Cannon et al.
2003/0195024 A1 10/2003 Slattery
2003/0211881 A1 11/2003 Walker et al.
2004/0053680 A1 3/2004 Schultz
2004/0142742 A1 7/2004 Schneider et al.
2004/0180717 A1 9/2004 Vancura
2004/0209662 A1 10/2004 Wadleigh
2004/0254019 A1 12/2004 Riendeau et al.
2005/0003886 A1 1/2005 Englman et al.
2005/0159207 A1 7/2005 Thomas
2005/0159209 A1 7/2005 Fiden et al.
2006/0009277 A1 1/2006 Hartl et al.
2006/0068893 A1 3/2006 Jaffe et al.
2006/0079316 A1 4/2006 Flemming et al.
2006/0079317 A1 4/2006 Flemming et al.
2006/0084495 A1 4/2006 Jaffe et al.
2006/0084496 A1 4/2006 Jaffe et al.
2006/0089194 A1 4/2006 Joshi et al.
2006/0160596 A1* 7/2006 Sato ..... G07F 17/32 463/16
2006/0258422 A1 11/2006 Walker et al.
2007/0254734 A1 11/2007 Gilmore et al.
2007/0259706 A1 11/2007 Anderson et al.
2007/0259713 A1 11/2007 Fiden et al.
2007/0265060 A1 11/2007 Hornik et al.
2007/0298856 A1 12/2007 Gilmore et al.
2008/0076542 A1 3/2008 Iddings et al.
2008/0113770 A1 5/2008 Gelber et al.
2008/0207298 A1 8/2008 Marks et al.
2009/0011822 A1 1/2009 Englman et al.
2009/0011824 A1 1/2009 Englman et al.
2010/0081497 A1 4/2010 Wolf et al.
2010/0113122 A1 5/2010 Walker et al.
2010/0124970 A1 5/2010 Pawloski et al.
2010/0137056 A1 6/2010 Hoffman et al.
2011/0003627 A1 1/2011 Nicely et al.
2011/0244935 A1* 10/2011 Matthews ..... G07F 17/3295 463/9
2011/0300926 A1 12/2011 Englman et al.
2012/0115580 A1* 5/2012 Hornik ..... G07F 17/34 463/25
2012/0122531 A1 5/2012 Aoki et al.
2012/0184351 A1* 7/2012 Hornik ..... G07F 17/3274 463/25
2012/0214580 A1 8/2012 Hoffman et al.
2012/0295699 A1* 11/2012 Reiche ..... A63F 13/10 463/29
2012/0329551 A1 12/2012 Arezina et al.
2013/0079110 A1 3/2013 Nicely et al.
2013/0084961 A1 4/2013 Radisich et al.
2013/0084962 A1 4/2013 Radisich et al.
2013/0084994 A1 4/2013 Farrar
2013/0095914 A1* 4/2013 Allen ..... G07F 17/3225 463/25

(56) References Cited

U.S. PATENT DOCUMENTS

| | | | | |
|---|---|---|---|---|
| 2013/0095917 | A1 | 4/2013 | Jaffe et al. | |
| 2013/0116046 | A1* | 5/2013 | Manton | A63F 13/00 463/31 |
| 2013/0150152 | A1 | 6/2013 | Cohen | |
| 2013/0210512 | A1 | 8/2013 | Meyer | |
| 2014/0274283 | A1* | 9/2014 | Helava | G07F 17/3267 463/20 |

FOREIGN PATENT DOCUMENTS

| | | |
|---|---|---|
| EP | 0431723 | 4/1990 |
| EP | 0896308 | 2/1999 |
| EP | 1253563 | 10/2002 |
| GB | 2062922 | 5/1981 |
| GB | 2072395 | 9/1981 |
| GB | 2092796 | 8/1982 |
| GB | 2197974 | 6/1988 |
| GB | 2241098 | 2/1990 |
| GB | 2226436 | 6/1990 |
| GB | 2229565 | 9/1990 |
| GB | 2320206 | 6/1998 |
| GB | 2332151 | 11/1998 |
| WO | WO 9522811 | 2/1995 |
| WO | WO 9712338 | 4/1997 |
| WO | WO 9851384 | 11/1998 |
| WO | WO 9929381 | 6/1999 |
| WO | WO 0133478 | 5/2001 |
| WO | WO 0221467 | 3/2002 |
| WO | WO 2005082480 | 2/2005 |
| WO | WO 2006002241 | 1/2006 |
| WO | WO 2006004831 | 1/2006 |
| WO | WO 2006004832 | 1/2006 |
| WO | WO 2006005073 | 1/2006 |
| WO | WO 2006017036 | 2/2006 |
| WO | WO 2006017067 | 2/2006 |
| WO | WO 2006017068 | 2/2006 |
| WO | WO 2006020811 | 2/2006 |
| WO | WO 2006026250 | 3/2006 |
| WO | WO 2006044252 | 4/2006 |
| WO | WO 2007103054 | 2/2007 |
| WO | WO 2008048634 | 4/2008 |

* cited by examiner

GAMING SYSTEM AND METHOD FOR PROVIDING A GAME WITH UNLOCKABLE FEATURES

PRIORITY CLAIM

This application claims priority to and the benefit of U.S. Provisional Patent Application Ser. No. 61/773,684, filed on Mar. 6, 2013, the entire contents of which are incorporated by reference herein.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards. In such known gaming machines, the amount of the wager made on the base game by the player can vary.

Secondary or bonus games are also known in gaming machines. The secondary or bonus games usually provide an additional award to the player. Secondary or bonus games usually do not require an additional wager by the player to be activated. Certain secondary or bonus games are activated or hit upon an occurrence of a designated triggering symbol or triggering symbol combination in the primary or base game. For instance, a bonus symbol occurring on the payline on the third reel of a three reel slot machine may hit the secondary bonus game. Part of the enjoyment and excitement of playing certain gaming machines is the occurrence or triggering of the secondary or bonus game (even before the player knows how much the bonus award will be).

Certain known gaming machines provide content that is static and predictable. That is, these gaming machines operate without regard to a player's unique personal preferences, and provide the same content (such as the same primary game and bonus game content) to every player. These gaming machines are not configured to adapt to each player's unique personal preferences such that each player's gaming experience is uniquely tailored to that player.

There is a continuing need to provide new and different gaming systems that dynamically provide different content and/or different features to different players based on such player's personal preferences.

SUMMARY

In various embodiments, the present disclosure relates generally to gaming systems and methods for providing unlockable features and/or unlockable content. In such embodiments, the gaming system includes a plurality of initially unlocked features or content and a plurality of initially locked features or content, wherein as the player advances or progresses during the play of one or more games, zero, one or more previously locked features or content become unlocked. In one such embodiment, which features or content become unlocked and/or a probability of certain features or content becoming unlocked is at least partially based on one or more player decisions pertaining to the play of one or more of the games. That is, the gaming system enables a player to make one or more decisions (e.g., select which of a plurality of characters or avatars to activate and select which of a plurality of primary games to play) wherein such decisions at least partially determine one or more of: which features or content are initially locked, which features or content are initially unlocked, which locked features or content is available to be unlocked and a probability of unlocking one or more of the locked features or content. Accordingly, the gaming system and method disclosed herein increases the level of excitement and enjoyment for certain players by dynamically providing, based at least in part on one or more player decisions, different features or content to different players.

In operation of certain embodiments, upon an initiation of an unlockable feature sequence disclosed herein, the gaming system enables the player to make a plurality of decisions related to the play of the initiated sequence. In one such embodiment, the gaming system enables the player to select: (i) one of a plurality of different characters or participants (e.g., avatars) to be associated with the player, and (ii) one of a plurality of different primary games to play.

In one embodiment, different characters or participants are associated with different attributes, characteristics or parameters. In this embodiment, the attributes, characteristics or parameters of each character at least partially determine that characters probability of success (and thus at least partially determine a player's probability of winning one or more awards). For example, as described below, different characters or participants are associated with different amounts of eligibility points (e.g., different quantities of life units), different attack symbols (or sub-symbols), and different amounts of damage incurred when attacked by different symbols (or sub-symbols).

In one embodiment, different primary games are associated with different attributes, characteristics or parameters. In this embodiment, the attributes, characteristics or parameters of each primary game at least partially determine a player's probability of winning one or more awards. For example, as described below, different primary games are associated with different playfield backgrounds, different reel sets or reel symbols and different opponents (wherein different opponents have different amounts of eligibility points (e.g., different quantities of life units), different attack symbols (or sub symbols), and different amounts of damage incurred when attacked by different symbols (or sub-symbols).

Following the selection of a character and a primary game to play, the gaming system displays a play of the selected primary game by determining and displaying any outcome for the play of the primary game. Additionally and in association with the play of the selected primary game, the gaming system determines if a bonus game triggering event occurs. If a bonus game triggering event occurs, the gaming system proceeds to a bonus game, such as a free spin battle between the players selected character and the opponent associated with the selected primary game.

In different embodiments wherein the bonus game is a free spin battle, during the bonus game, based on one or more symbols generated by one or more separate, independent reels (or based on one or more sub-symbols generated), the initial amount of eligibility points of the player's character, the initial amount of eligibility points of the opponent, the amount of damage incurred to the player's character by one or more generated symbols (or sub-symbols), and the amount of damage incurred to the opponent by one or more generated symbols (or sub-symbols), the gaming system determines whether or not the player's character defeats the opponent associated with the selected primary game.

If the player's character does not defeat the opponent associated with the selected primary game, the gaming system enables the player to: (i) place another wager to initiate another play of the selected primary game, or (ii) select another unlocked participant and/or another unlocked primary game to play. That is, if the player's character is defeated in a battle, the gaming system enables the player to: (i) switch to another unlocked character to be associated with the player, (ii) switch to another unlocked primary game to play, (iii) switch to another unlocked character to be associated with the player, and another unlocked primary game to play, or (iv) continue on to another play of the previously selected primary game with the previously selected character.

If the player's character defeats the opponent associated with the selected primary game, the gaming system determines if any undefeated opponents remain associated with the selected primary game. That is, the gaming system determines whether the player's selected character has successfully defeated each of the opponents associated with the player's selected primary game.

If at least one undefeated opponent remains associated with the selected primary game, the gaming system displays a free spin battle between the player's character and this opponent, wherein, as described above, based on one or more symbols generated by one or more separate independent reels (or based on one or more sub-symbols generated), the initial amount of eligibility points of the player's character and this opponent and the amount of damage incurred to both the player's character and this opponent by any symbols (or sub-symbols) generated, the gaming system determines whether or not the player's character defeats this opponent associated with the selected primary game.

It should be appreciated that since the determination of whether or not a player advances to another free spin battle is determined, at least in part, on which symbols are generated during the free spins, the quantity of free spins of the bonus game is at least partially determined based on which symbols (or which sub-symbols) are generated during the free spin bonus game. It should be further appreciated that since the determination of whether or not a player advances to another free spin battle is determined, at least in part, on the attributes of the player selected character and the attributes of the opponent associated with the player selected primary game, the quantity of free spins of the bonus game is at least partially determined based on one or more player selections (i.e., which character the player selects and which primary game the player selects to play).

The above-described process of defeating opponents associated with the selected primary game and advancing to battle additional, previously, undefeated opponents also associated with the selected primary game until no undefeated opponents remain associated with the selected primary game (i.e., the player's character has defeated each of the opponents associated with the selected primary game).

When no undefeated opponents remain associated with the selected primary game, the gaming system unlocks a feature or content for the player to subsequently access. For example, if two characters and two primary games are initially unlocked and available for the player to select, then if the player's character defeats each of the opponents of the first primary game, a third primary game is unlocked and designated as available to the player. In this example, if the player's character defeats each of the opponents of the second primary game, a third character is unlocked and designated as available to the player. Additionally, in this example, if the player's character defeats each of the opponents of the third primary game, a fourth primary game is unlocked and designated as available to the player. Moreover, if the player's character defeats each of the opponents of the fourth primary game, a fourth character is unlocked and designated as available to the player.

It should be appreciated that since the determination of whether an opponent of the selected primary game is defeated is determined, at least in part, on which symbols are generated during the free spins and since each of the opponents associated with a primary game are defeated to unlock additional features, which features are unlocked is at least partially determined based on which symbols (or which sub-symbols) are generated. It should be further appreciated that since the determination of whether or not another feature is unlocked (e.g., whether or not another character or primary game becomes available) is determined, at least in part, on the attributes of the player selected character and the attributes of the opponent associated with the player selected primary game, which features are unlocked is at least partially determined based on one or more player selections (i.e., which character the player selects and which primary game the player selects to play).

Such a configuration of enabling a player to make one or more decisions regarding how to play a game, wherein such decisions affect not only the outcome of the play of the game, but which previously locked features will become unlocked, provides an increased amount of excitement and enjoyment for certain players.

Additional features and advantages are described in, and will be apparent from, the following Detailed Description and the figures.

BRIEF DESCRIPTION OF THE FIGURES

FIG. 23 is a schematic block diagram of one embodiment of an electronic configuration of the gaming system disclosed herein.

DETAILED DESCRIPTION

Unlockable Features

In various embodiments, the gaming system and method disclosed herein provides for unlockable features and/or unlockable content. In such embodiments, the gaming system includes a plurality of initially unlocked features or content and a plurality of initially locked features or content, wherein as the player advances or progresses during the play of one or more games, zero, one or more previously locked features or content become unlocked. In one such embodiment, which features or content become unlocked and/or a probability of certain features or content becoming unlocked is at least partially based on one or more player decisions pertaining to the play of one or more of the games. That is, the gaming system enables a player to make one or more decisions (e.g., select which of a plurality of characters or avatars to activate and select which of a plurality of primary games to play) wherein such decisions at least partially determine one or more of: which features or content are initially locked, which features or content are initially unlocked, which locked features or content is available to be unlocked and a probability of unlocking one or more of the locked features or content. Accordingly, the gaming system and method disclosed herein increases the level of excitement and enjoyment for certain players by dynamically providing, based at least in part on one or more player decisions, different features or content to different players.

While certain of the embodiments described below are directed to a primary wagering game, it should be appreciated that the present disclosure may additionally or alternatively be employed in association with a secondary or bonus game. Moreover, while the player's credit balance, the player's wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

Figure 1:
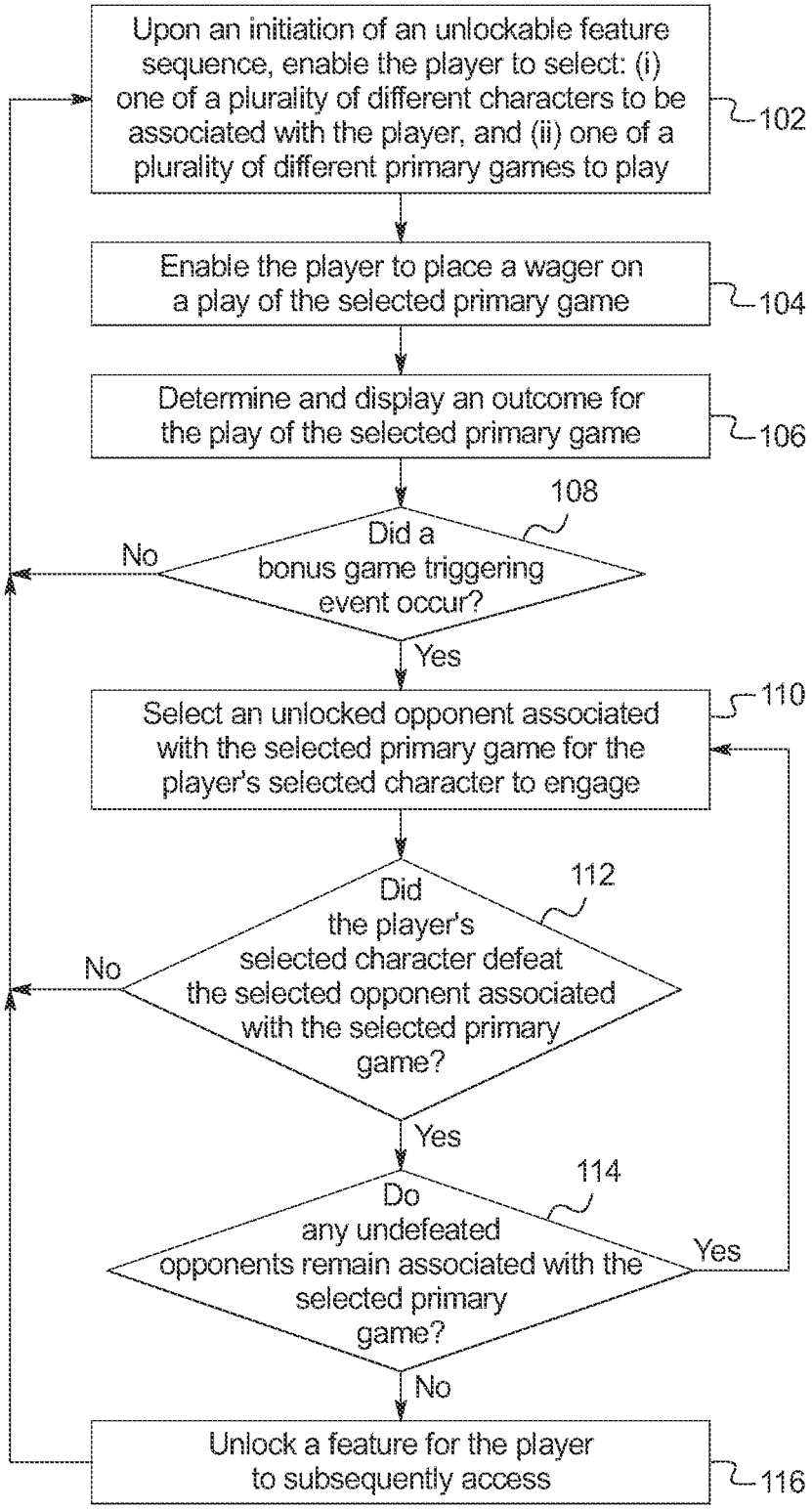
FIG. 1 is a flow chart an example process for operating a gaming system including unlocking one or more features as disclosed herein.

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In operation of certain embodiments, upon an initiation of an unlockable feature sequence disclosed herein, the gaming system enables the player to make a plurality of decisions related to the play of the initiated sequence. In one such embodiment, as indicated in block 102 of FIG. 1, upon an initiation of an unlockable feature sequence, the gaming system enables the player to select: (i) one of a plurality of different characters or participants (e.g., avatars) to be associated with the player, and (ii) one of a plurality of different primary games to play.

In one embodiment, different characters or participants are associated with different attributes, characteristics, skills or parameters. In this embodiment, the attributes, characteristics, skills or parameters of each character at least partially determine that characters probability of success (and thus at least partially determine a player's probability of winning one or more awards). For example, as described below, different characters or participants are associated with different amounts of eligibility points (e.g., different quantities of life units), different attack symbols (or sub-symbols), and different amounts of damage incurred when attacked by different symbols (or sub-symbols).

In one embodiment, different primary games are associated with different attributes, characteristics or parameters. In this embodiment, the attributes, characteristics or parameters of each primary game at least partially determine a player's probability of winning one or more awards. For example, as described below, different primary games are associated with different playfield backgrounds, different reel sets or reel symbols and different opponents (wherein different opponents have different amounts of eligibility points (e.g., different quantities of life units), different attack symbols (or sub-symbols), and different amounts of damage incurred when attacked by different symbols (or sub-symbols).

Following the selection of a character and a primary game to play, as indicated in blocks 104 and 106, the gaming system enables the player to place a wager on a play of the selected primary game and then determines and displays an outcome for the play of the selected primary game.

Additionally and in association with the play of the selected primary game, the gaming system determines if a bonus game triggering event occurs as indicated in diamond 108.

If a bonus game triggering event occurs, the gaming system proceeds to a bonus game associated with the selected primary game. Specifically, in certain embodiments, if a bonus game triggering event occurs, as indicated in block 110, the gaming system selects an unlocked opponent associated with the selected primary game for the player's selected character to engage.

In the bonus game, as indicated in diamond 112, the gaming system determines if the player's selected character defeats the selected opponent associated with the selected primary game. In one such embodiment, the bonus game includes a free spin battle between the player's selected character and the opponent associated with the selected primary game.

In one embodiment wherein the bonus game is a free spin battle, during the bonus game, based on one or more symbols generated by one or more separate independent reels, such as which symbols are generated by the player's independent reel(s) and which symbols are generated by an opponent's independent reel(s), the initial amount of eligibility points of the player's character, the initial amount of eligibility points of the opponent, the amount of damage incurred to the player's character by one or more generated symbols, and the amount of damage incurred to the opponent by one or more generated symbols, the gaming system determines whether or not the player's character defeats the opponent associated with the selected primary game.

In another embodiment wherein the bonus game is a free spin battle, during the bonus game, based on one or more sub-symbols generated, the initial amount of eligibility points of the player's character, the initial amount of eligibility points of the opponent, the amount of damage incurred to the player's character by one or more generated sub-symbols, and the amount of damage incurred to the opponent by one or more generated sub-symbols, the gaming system determines whether or not the player's character defeats the opponent associated with the selected primary game.

In these embodiments, each play of the free spin includes a random symbol generation which represents different game events, actions or sequences for the participant and the opponent. That is, the symbols or symbol combinations generated determine which game events, actions or sequences the gaming system causes to occur for the battle. Based on such game events, actions and sequences, the gaming system determines whether the player's character or the opponent wins the battle. In one embodiment, the gaming system also determines whether to provide the player an award based on the randomly generated symbol combination, such that the symbol combination randomly generated serves two functions: (i) to determine an action or sequence in the battle, and (ii) to determine if the player receives an award.

In one embodiment, for each free spin battle, the gaming system compares the randomly generated symbols (or sub-symbols) for the players character to the randomly generated symbols (or sub-symbols) for the opponent to determine the result or outcome of that battle spin. Based on one or more of such comparisons, the gaming system determines a result or outcome of the battle between the player's character and the opponent. After such a comparison, the gaming system determines whether to increase, decrease or not change: (i) a character eligibility meter, (ii) an opponent eligibility meter, (iii) a credit meter, or (iv) any combination of the player eligibility meter, the opponent eligibility meter, and the credit meter. Based on such meters, the gaming system determines if any of the player's character and/or the opponent have been defeated.

In one embodiment, the gaming system utilizes a point-based system to determine if any characters are defeated and/or if any opponents are defeated. In one such embodiment, the gaming system associates a number of life points to each character and each opponent. In this embodiment, when an opponent and a character battle, the gaming system causes the opponent and/or the character to lose or forfeit zero, one or more associated life points. In one such embodiment, the gaming system causes zero, one or more life points to be lost as a result of zero, one or more symbols (or sub-symbols) being generated. In these embodiments, if the total quantity of life points remaining for an opponent and/or a character to reach a designated threshold quantity, such as zero points remaining, the gaming system causes that opponent or character to be defeated. In these embodiments, the number of life points of a character and/or opponent defines a likelihood or probability of that character and/or opponent surviving a battle. In one such embodiment, the quantity of lost life points is based on the attributes of the character and the attributes of the opponent.

If the player's character does not defeat the selected opponent associated with the selected primary game or the gaming system determines that the bonus game triggering event did not occur, the gaming system returns to block 102 and enables the player to modify zero, one or more of the selected character and/or the selected primary game. That is, the gaming system enables the player to: (i) not modify the selected unlocked participant or the selected primary game (and rather to place another wager to initiate another play of the selected primary game), or (ii) select another unlocked participant and/or another unlocked primary game to play. Put differently, if the player's character is defeated in a battle, the gaming system enables the player to: (i) switch to another unlocked character to be associated with the player, (ii) switch to another unlocked primary game to play, (iii) switch to another unlocked character to be associated with the player, and another unlocked primary game to play, or (iv) continue on to another play of the previously selected primary game with the previously selected character.

On the other hand, if the player's character defeats the selected opponent associated with the selected primary game, the gaming system determines if any undefeated opponents remain associated with the selected primary game as indicated in diamond 114. That is, the gaming system determines whether the player's selected character has successfully defeated each of the opponents associated with the player's selected primary game.

If at least one undefeated opponent remains associated with the selected primary game, the gaming system returns to block 110 and selects another unlocked opponent associated with the selected primary game for the player's selected character to engage.

In certain embodiments, for this selected opponent, the gaming system displays a free spin battle between the player's character and this opponent, wherein, as described above, based on one or more symbols (or sub-symbols) generated, the initial amount of eligibility points of the player's character and this opponent and the amount of damage incurred to both the player's character and this opponent by any symbols (or sub-symbols) generated, the gaming system determines whether or not the players character defeats this opponent associated with the selected primary game.

It should be appreciated that since the determination of whether or not a player advances to another free spin battle is determined, at least in part, on which symbols are generated during the free spins, the quantity of free spins of the bonus game is at least partially determined based on which symbols (or which sub-symbols) are generated during the free spin bonus game. It should be further appreciated that since the determination of whether or not a player advances to another free spin battle is determined, at least in part, on the attributes of the player selected character and the attributes of the opponent associated with the player selected primary game, the quantity of free spins of the bonus game is at least partially determined based on one or more player selections (i.e., which character the player selects and which primary game the player selects to play).

The above-described process of defeating opponents associated with the selected primary game and advancing to battle additional, previously, undefeated opponents also associated with the selected primary game until no undefeated opponents remain associated with the selected primary game (i.e., the player's character has defeated each of the opponents associated with the selected primary game).

When no undefeated opponents remain associated with the selected primary game, the gaming system unlocks a feature or content for the player to subsequently access. Specifically, as seen in block 116 of FIG. 1, if the gaming system determines that no undefeated opponents remain associated with the selected primary game, the gaming system unlocks a feature or content for the player to subsequently access. For example, if two characters and two primary games are initially unlocked and available for the player to select, then if the player's character defeats each of the opponents of the first primary game, a third primary game is unlocked and designated as available to the player. In this example, if the player's character defeats each of the opponents of the second primary game, a third character is unlocked and designated as available to the player. Additionally, in this example, if the player's character defeats each of the opponents of the third primary game, a fourth primary game is unlocked and designated as available to the player. Moreover, if the player's character defeats each of the opponents of the fourth primary game, a fourth character is unlocked and designated as available to the player.

Following the unlocking of a feature or content, the gaming system returns to block 102 and enables the player to modify zero, one or more of the selected character and/or the selected primary game. That is, the gaming system enables the player to: (i) not modify the selected unlocked participant or the selected primary game (and rather to place another wager to initiate another play of the selected primary game), or (ii) select another unlocked participant and/or another unlocked primary game to play, wherein the previously locked and subsequently unlocked feature or content may be available for selection by the player.

It should be appreciated that since the determination of whether an opponent of the selected primary game is defeated is determined, at least in part, on which symbols are generated during the free spins and since each of the opponents associated with a primary game are defeated to unlock additional features, which features are unlocked is at least partially determined based on which symbols (or which sub-symbols) are generated. It should be further appreciated that since the determination of whether or not another feature is unlocked (e.g., whether or not another character or primary game becomes available) is determined, at least in part, on the attributes of the player selected character and the attributes of the opponent associated with the player selected primary game, which features are unlocked is at least partially determined based on one or more player selections (i.e., which character the player selects and which primary game the player selects to play).

In one example embodiment, upon an initiation of an unlockable feature sequence, the gaming system provides a player two sets of choices. Specifically, in this example, the gaming system enables the player to pick a character and a realm (i.e., a primary game to play). The player's choice of character changes certain reel symbols and also affects how the player fights monsters (i.e., opponents) in a battle bonus (i.e., a play of a free spin bonus game). The player's choice of realm affects the main playfield background, certain reel symbols and determines which monsters the player's character will fight in the battle bonus.

In this example, the gaming system enables the player to switch their character and/or realm before any spin by pressing a button on the screen. It should be appreciated that in certain embodiments, a plurality of (or each of) the combinations of characters and realms have the same average expected payout, though their player experiences may vary. In certain embodiments, a plurality of (or each of) the combinations of characters and realms have different average expected payouts.

In operation of this example embodiment, the gaming system presents the player two characters and two realms to choose from. In this embodiment, as the player advances through different plays of the games, the gaming system unlocks one or more features or otherwise makes one or more features or content available of the player to subsequently select. For example: (i) if the player manages to defeat the top monster in the first realm, a third realm will become available to the player, (ii) if the player manages to defeat the top monster in the second realm, a third character will become available to the player, (iii) if the player manages to defeat the top monster in the third realm, a fourth realm will become available to the player, and (iv) if the player manages to defeat the top monster in the fourth realm, a fourth character will become available to the player.

Following the player selecting a character and a realm, if a battle bonus is triggered, the gaming system provides the player one or more free plays or free spins. During the free spin bonus, the character and a first monster fight via the appearance of certain symbols (or sub-symbols) on the reels. Both the character and first monster have different attributes, characteristics or parameters, such as a certain number of life points, and different numbers of symbols (or sub-symbols) which may do different amounts of damage and have other affects. In this example, if the character defeats the first monster without being defeated, the character goes on to fight a second monster. If the character defeats the third monster, the character goes on to fight a final boss monster. The player bonus ends when their character is defeated or the character defeats the final boss monster. Such a configuration provides that the player's quantity of free spins is determined by how the player's selected character performs in defeating monsters in the triggered bonus.

As different characters have different attributes, it should be appreciated that the player's choice of character impacts how the bonus free spin game will play out. That is, each character may have different amounts of starting life points, different numbers of attack symbols (or sub-symbols), different numbers of attack types, and different amounts of damage that are done when a given attack symbol (or sub-symbol) appears. Based on the attributes of the player's selected character, the attributes of the monster or opponent of the player's selected realm and which symbols are generated, the gaming system determines which characters defeat which opponents and which opponents defeat which characters.

Similarly, as different opponents (e.g., monsters) have different attributes, it should be appreciated that the player's choice of realms (i.e., the player's choice of which primary game associated with which opponents to play) impacts how the bonus free spin game will play out. That is, each opponent may have different amounts of starting life points, different numbers of attack symbols (or sub-symbols), different numbers of attack types, and different amounts of damage that are done when a given attack symbol (or sub-symbol) appears. Based on the attributes of the opponent of the player's selected realm, the attributes of the player's selected character and which symbols are generated, the gaming system determines which characters defeat which opponents and which opponents defeat which characters.

In an alternative embodiment, the gaming system enables the player to choose the opponent(s) the player wants to play against. In one such embodiment, an opponent that is relatively easier to defeat is associated with providing the player with smaller awards (i.e., such that the gaming system enables the player to select the volatility of one or more games). In another such embodiment, the gaming system enables the player choose to play against a single powerful opponent or a series of weaker ones. In one such embodiment, the gaming system causes the final opponent to be selectable (without the player first defeating other opponents of the current realm. In this embodiment, certain defeated final opponents are associated with unlocking new realms or domains and other defeated final opponents are associated with unlocking new characters.

It should be further appreciated that enabling a player to make one or more decisions regarding how to play a game, wherein such decisions affect not only the outcome of the play of the game, but which previously locked features will become unlocked, provides an increased amount of excitement and enjoyment for certain players. For example, if a player selects a first path, that player could: (i) beat a final opponent (e.g., monster) in realm one and unlock realm three, then (ii) beat a final opponent (e.g., monster) in realm three and unlock realm four, then (iii) beat a final opponent (e.g., monster) in realm four and unlock character four, and then (iv) beat a final opponent (e.g., monster) in realm two and unlock character three. On the other hand, if the same player selects a second, different path, that player could: (i) beat a final opponent (e.g., monster) in realm two and unlock character three, then (ii) beat a final opponent (e.g., monster) in realm one and unlock realm three, then (iii) beat a final opponent (e.g., monster) in realm three and unlock realm four, and then (iv) beat a final opponent (e.g., monster) in realm four and unlock character four. Such different paths result in different realms being unlocked in different orders which certain players enjoy.

In one embodiment, each free spin game includes the same symbols and/or the same sub-symbols. In another embodiment, different free spin games include different symbols and/or different sub-symbols. In one such embodiment, the symbols and/or sub-symbols to utilize in the free spin game are partially determined by the player's selected character and the player's selected primary game.

In one embodiment, as mentioned above, different characters are associated with different attributes, such as the sub-symbols available to be generated in any battles including that character. For example, different sub-symbols associated with different characters include, but are not limited to, a shield sub-symbol that protects against a certain amount of opponent damage, an evade sub-symbol that keeps the character safe from all damage on that spin, a heal sub-symbol that heals a certain amount of life points, a poison sub-symbol that prevents the opponent from attacking next round, and a life drain sub-symbol that drains one or more life points from the opponent and uses it to boost the character's life points.

In one embodiment, different opponents in different rounds have different features. For example, a first free spin battle between a player's character and an opponent is played with cascading reels. In this example, after defeating the first opponent, a second free spin battle between the player's character and a second opponent is played with cascading reels with a stack wild symbols feature. In this example, after defeating the second opponent, a third free spin battle between the player's character and a second opponent is played with cascading reels with a 2X stack wild symbols feature.

In one embodiment, after a feature or content is unlocked, the gaming system enables the player to selectively access that unlocked feature at the player's discretion. That is, the gaming system enables a player to go back and try to defeat a previously fought opponent, but with a new character.

In another embodiment, the gaming system employs one or more enhancers which increase a character's chances of defeating an opponent. In one such embodiment, a plurality of or each of the primary games or realms are associated with or otherwise share different enhancers, such as items that are associated with an award value and further increase the attributes of a selected character (and/or decrease the attributes of one or more opponents). For example, (i) one item provides one-time protection against one point of opponent damage, (ii) one item provides a one-time boost of one more point damage against an opponent; (ii) one item removes the effects of poison, and (iv) one item provides a new kind of attack (i.e., additional sub-symbols) on the reels for one or more spins during a free spin battle. In this embodiment, each item helps the player's character in the next battle against an opponent. In one such embodiment, each of the characters can use each of any acquired items and each of the items can be used in each of the primary games. In one embodiment, the gaming system enables the player to keep a limited inventory of items. In another embodiment, similar to the above-described unlocking of features and content, the gaming system unlocks one or more enhancers as the play of the game progresses. For example, initially, there are two types of items the player obtains via one or more plays of one or more games. After the player has played such games four times, the gaming system unlocks a third item. In this example, after the player has played such games four more times, the gaming system unlocks a fourth item.

In another embodiment, each primary game or realm includes discrete items which can only be accumulated and utilized within a specific realm. In another embodiment, each primary game or realm includes discrete items for each character which can only be accumulated by that character and utilized by that character within a specific realm.

In one embodiment, after an item is accumulated, the gaming system enables the player to selectively utilize that accumulated item in any of the unlocked features. That is, the gaming system enables a player to go back and try to defeat a previously fought opponent, but with a new accumulated item.

In one embodiment, the gaming system provides a group gaming aspect to the unlockable feature sequence disclosed herein. In one such embodiment, the unlockable feature sequence is a cooperative community game wherein a plurality of players cooperate or play together to win one or more awards. In another such embodiment, the unlockable feature sequence is a competition community game wherein a plurality of players compete or play against each other to win one or more awards.

In one embodiment, the gaming system causes at least one display device of the player's gaming device to display the unlockable feature sequence. In another embodiment, in addition or in alternative to each gaming device displaying the unlockable feature sequence, the gaming system causes one or more community or overhead display devices to display part or all of the unlockable feature sequence to one or more other players or bystanders either at a gaming establishment or viewing over a network, such as the internet. In another embodiment, in addition or in alternative to each gaming device displaying the unlockable feature sequence, the gaming system causes one or more internet sites to each display the unlockable feature sequence such that a player is enabled to log on from a personal web browser. In another such embodiment, the gaming system enables the player to play one or more primary games on one device while viewing the unlockable feature sequence from another device. For example, the gaming system enables the player to play one or more primary games on a mobile phone while viewing the status of the unlockable feature sequence on a desktop or laptop computer.

In another embodiment, an unlockable feature sequence triggering event occurs and/or a battle bonus triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes a unlockable feature sequence triggering event to occur and/or a battle bonus triggering event to occur.

In another embodiment, the gaming system does not provide any apparent reasons to the players for a unlockable feature sequence triggering event to occur and/or for a battle bonus triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one such embodiment, an unlockable feature sequence triggering event occurs and/or a battle bonus triggering event occurs based on an amount of coin-in. In this embodiment, the gaming system determines if an amount of coin-in reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, an unlockable feature sequence triggering event occurs and/or a battle bonus triggering event occurs based on an amount of non-monetary currency-in. In this embodiment, the gaming system determines if an amount of non-monetary currency-in wagered reaches or exceeds a designated amount of non-monetary currency-in (i.e., a threshold non-monetary currency-in amount). Upon the amount of non-monetary currency-in wagered reaching or exceeding the threshold non-monetary currency-in amount, the gaming system causes one or more of such events or conditions to occur. In different embodiments, the threshold coin-in amount and/or the threshold non-monetary currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, an unlockable feature sequence triggering event occurs and/or a battle bonus triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, an unlockable feature sequence triggering event occurs and/or a battle bonus triggering event occurs based on an amount of non-monetary currency-out. In this embodiment, the gaming system determines if an amount of non-monetary currency-out reaches or exceeds a designated amount of non-monetary currency-out (i.e., a threshold non-monetary currency-out amount). Upon the amount of non-monetary currency-out reaching or exceeding the threshold non-monetary currency-out amount, the gaming system causes one or more of such events or conditions to occur. In different embodiments, the threshold coin-out amount and/or the threshold non-monetary currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, an unlockable feature sequence triggering event occurs and/or a battle bonus triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, an unlockable feature sequence triggering event occurs and/or a battle bonus triggering event occurs, based on a quantity of games played. In this embodiment, a quantity of games played is set for when one or more of such events or conditions will occur. In one embodiment, such a set quantity of games played is based on historic data.

In another alternative embodiment, an unlockable feature sequence triggering event occurs and/or a battle bonus triggering event occurs, based on time. In this embodiment, a time is set for when one or more of such events or conditions will occur. In one embodiment, such a set time is based on historic data.

In another alternative embodiment, an unlockable feature sequence triggering event occurs and/or a battle bonus triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, an unlockable feature sequence triggering event occurs and/or a battle bonus triggering event occurs, based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, an unlockable feature sequence triggering event occurs and/or a battle bonus triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a unlockable feature sequence triggering event to occur and/or a battle bonus triggering event to occur may be implemented in accordance with the gaming system and method disclosed herein.

It should be appreciated that any of the above-described unlockable feature sequence triggering events may be combined in one or more different embodiments.

Alternative Embodiments

It should be appreciated that in different embodiments, one or more of:

i. a quantity of features or content initially unlocked;
ii. which features or content is initially unlocked;
iii. a quantity of features or content initially locked;
iv. which features or content is initially locked;
v. a quantity of characters or participants initially unlocked;
vi. which characters or participants are initially unlocked;
vii. one or more attributes of each initially unlocked character;
viii. a quantity of characters or participants initially locked;
ix. which characters or participants are initially locked;
x. one or more attributes of each initially locked character;
xi. a quantity of games or realms initially unlocked;
xii. which games or realms are initially unlocked;
xiii. one or more attributes of each initially unlocked game or realm;
xiv. a quantity of games or realms initially locked;
xv. which games or realms are initially locked;
xvi. one or more attributes of each initially locked game or realm;
xvii. which symbols and/or sub-symbols are associated with each character;
xviii. which symbols and/or sub-symbols are associated with each game or realm;
xix. a quantity of enhancers initially unlocked;
xx. which enhancers are initially unlocked;
xxi. one or more attributes of each initially unlocked enhancer;
xxii. a quantity of enhancers initially locked;
xxiii. which enhancers are initially locked;
xxiv. one or more attributes of each initially locked enhancer;
xxv. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 2A:
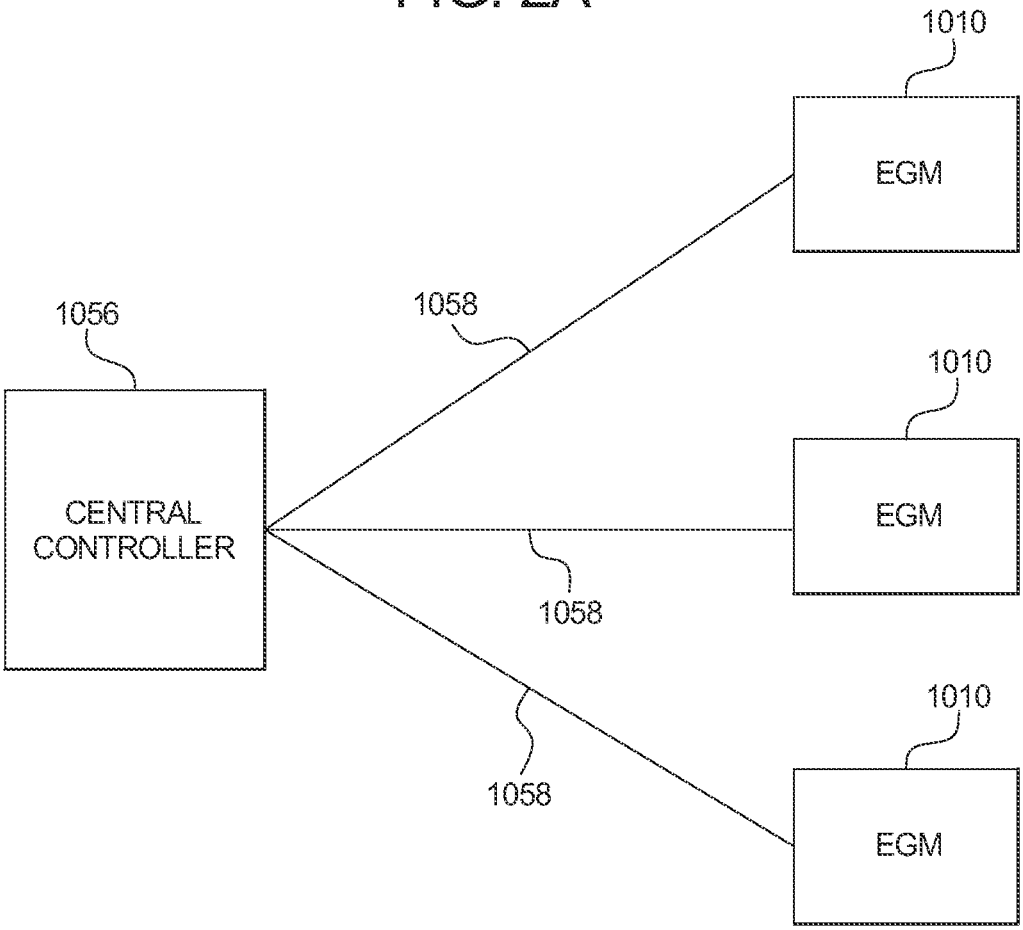
FIG. 2A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 2A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 23 illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 23 includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 2B:
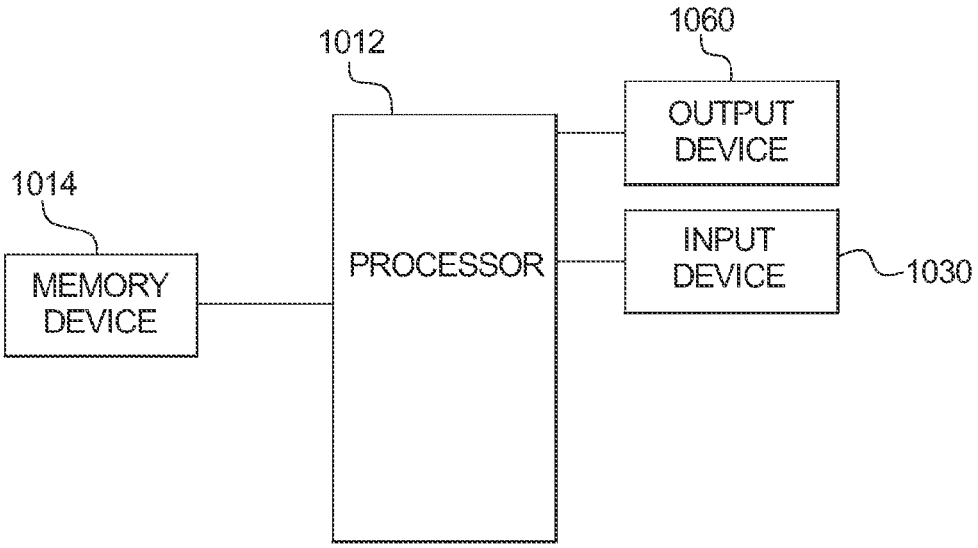
Figure 3A:
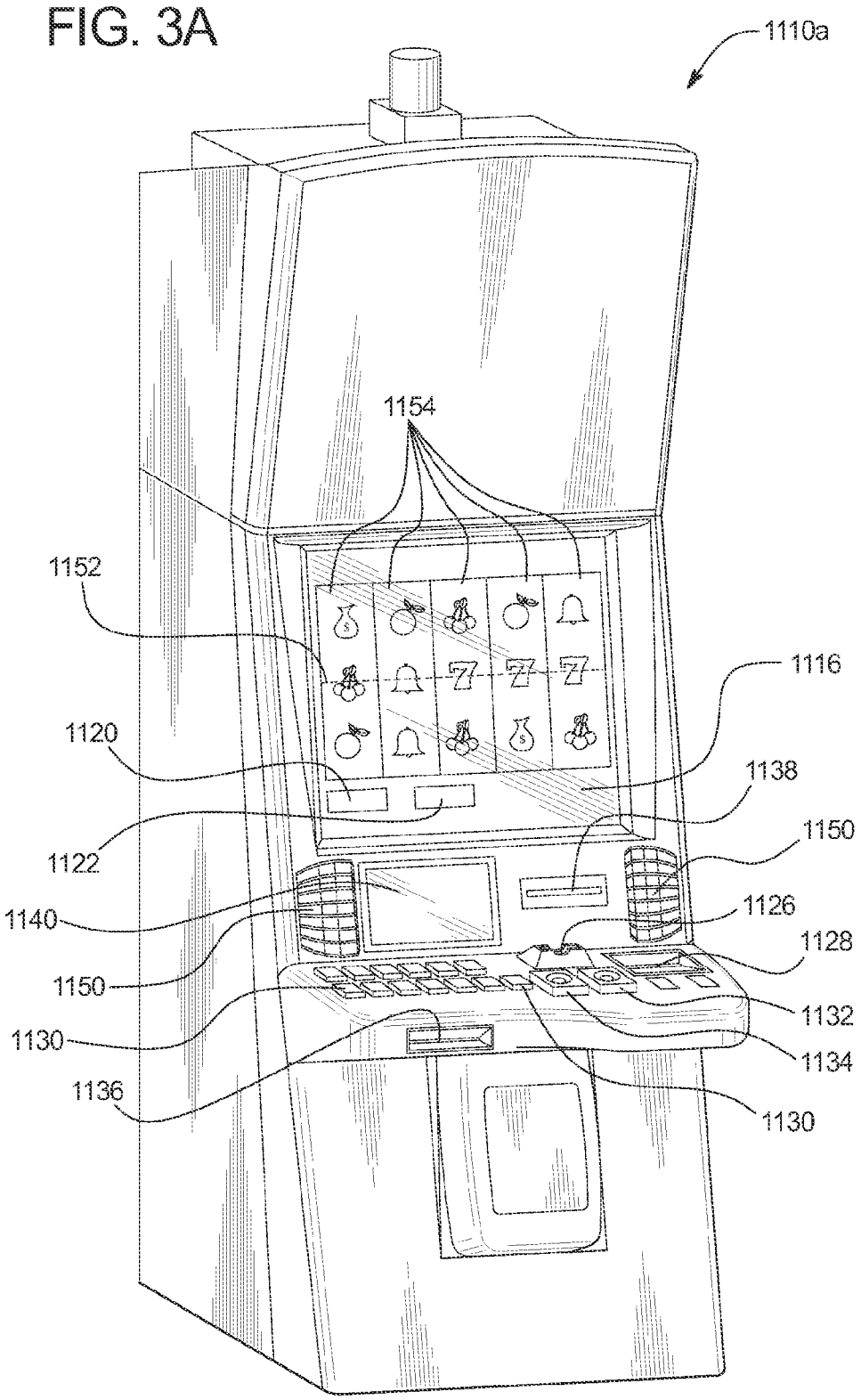
FIGS. 3A and 3B are perspective views of example alternative embodiments of the gaming system disclosed herein.
Figure 3B:
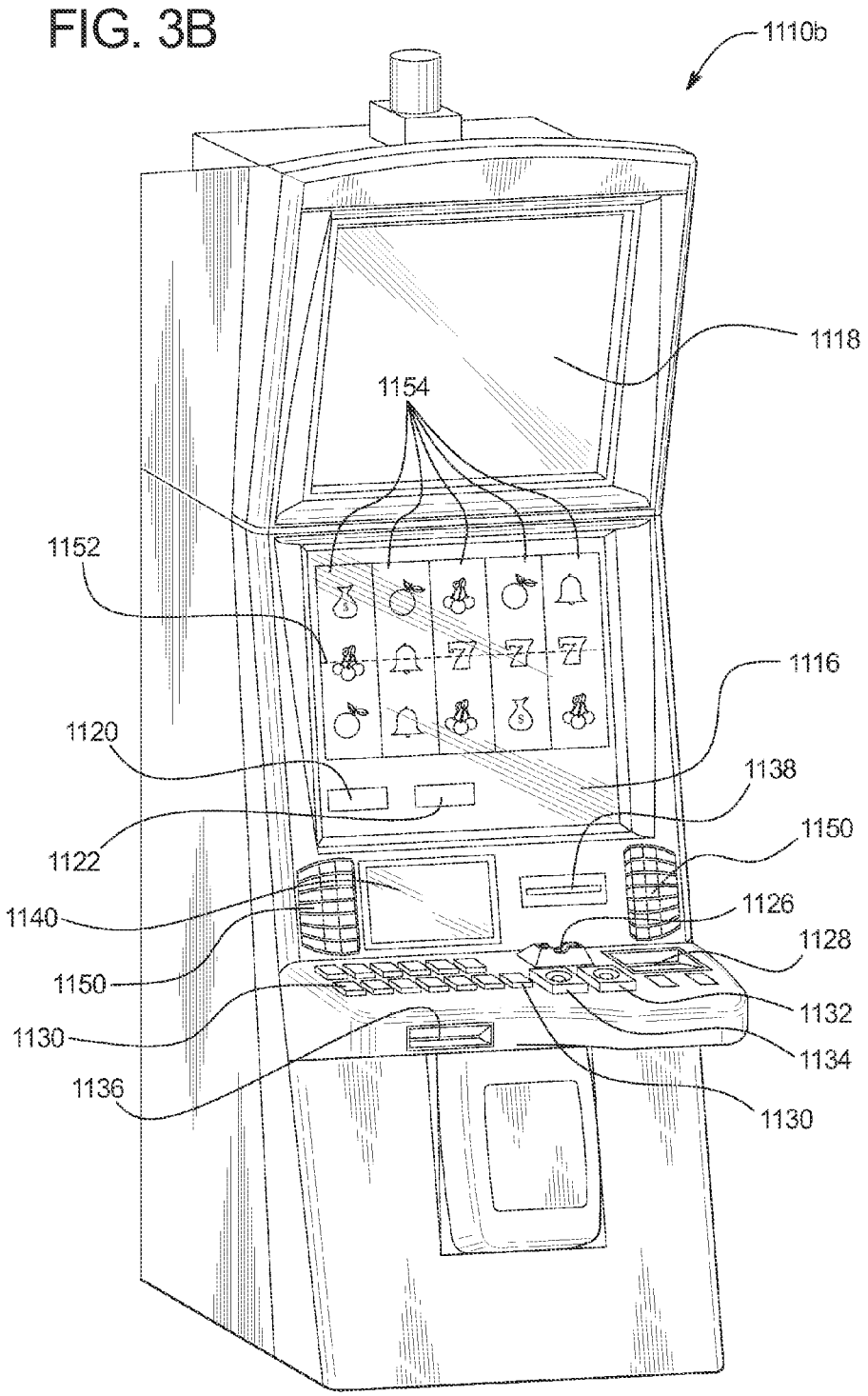

In various embodiments, the EGM includes one or more input devices. The input devices may include any suitable device that enables an input signal to be produced and received by the at least one processor of the EGM. The example EGM illustrated in FIG. 2B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 3A and 3B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 3A and 3B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 3A and 3B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 3A and 3B each include a card reader 1138. The card reader is configured to read a player identification card inserted into the card reader.

In various embodiments, the EGM includes one or more output devices. The example EGM illustrated in FIG. 2B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 3A includes a central display device 1116, a player tracking display 1140, a credit display 1120, and a bet display 1122. The example EGM illustrated in FIG. 3B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 3A and 3B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 3A and 3B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 3A and 3B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 3A and 3B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 3A and 3B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 200810070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item;

(b) enable a player to select an unlocked character from a plurality of different characters, wherein a plurality of said characters are initially unlocked, at least one of the characters is initially locked, and each of the characters is associated with at least one of a plurality of character attributes;

(c) enable the player to select an unlocked game from a plurality of different games, wherein a plurality of said games are initially unlocked, at least one of the games is initially locked, and each of the games is associated with at least one of a plurality of game attributes;

(d) for a play of the selected game:

(i) determine a game outcome, (ii) display the determined game outcome, (iii) determine any award associated with the determined game outcome, and (iv) display any determined award, wherein the credit balance is increasable based on any determined award;

(e) if a bonus game triggering event occurs:

(i) display a quantity of free games, wherein the quantity of free games is determined based on the at least one character attribute of the selected character and the at least one game attribute of the selected game;

(ii) if a character unlock event occurs in association with at least one of the free games, unlock at least one of any locked characters, and (iii) if a game unlock event occurs in association with at least one of the free games, unlock at least one of any locked games; and (f) if a cashout input is received via the cashout device, cause an initiation of any payout associated with the credit balance.

2. The gaming system of claim 1, wherein when executed by the at least one processor if the character unlock event occurs in association with at least one of the free games, the plurality of instructions cause the at least one processor to enable the player to select the unlocked character for another play of the selected game.

3. The gaming system of claim 1, wherein when executed by the at least one processor if the game unlock event occurs in association with at least one of the free games, the plurality of instructions cause the at least one processor to enable the player to select to play said unlocked game.

4. The gaming system of claim 1, wherein when executed by the at least one processor if the character unlock event occurs in association with at least one of the free games and if the game unlock event occurs in association with at least one of the free games, the plurality of instructions cause the at least one processor to enable the player to select the unlocked character and enable the player to select to play said unlocked game.

5. The gaming system of claim 1, wherein when executed by the at least one processor if the bonus game triggering event occurs, the plurality of instructions cause the at least one processor to, for each of the displayed quantity of free games: (i) determine a free game outcome, (ii) display the determined free game outcome, (iii) determine any free game award associated with the determined free game outcome, and (iv) display any determined free game award.

6. The gaming system of claim 1, wherein when executed by the at least one processor, the plurality of instructions cause the at least one processor to determine if the character unlock event occurs based on the at least one character attribute of the selected character and the at least one game attribute of the selected game.

7. The gaming system of claim 1, wherein when executed by the at least one processor, the plurality of instructions cause the at least one processor to determine if the game unlock event occurs based on the at least one character attribute of the selected character and the at least one game attribute of the selected game.

8. The gaming system of claim 1, wherein when executed by the at least one processor, the plurality of instructions cause the at least one processor to determine the quantity of free games based on at least one random determination associated with at least one of the free games.

9. The gaming system of claim 1, wherein when executed by the at least one processor, the plurality of instructions cause the at least one processor to save, in association with the player, data representing which of any characters are unlocked, which of any characters are locked, which of any games are unlocked and which of any games are locked.

10. The gaming system of claim 1, wherein the quantity of free games include a plurality of free activations of the selected game.

11. The gaming system of claim 1, wherein at least one of any determined award is at least one selected from the group of: a quantity of monetary credits, a quantity of non-monetary credits, a quantity of promotional credits, and a quantity of player tracking points.

12. A gaming system server comprising:

at least one processor; and at least one memory device which stores a plurality of instructions, which when executed by the at least one processor, cause the at least one processor to:

(a) if data associated with a receipt of a physical item via an acceptor is received, establish a credit balance based, at least in part, on a monetary value associated with the received physical item;

(b) receive data representing a player selection of an unlocked character from a plurality of different characters, wherein a plurality of said characters are initially unlocked, at least one of the characters is initially locked, and each of the characters is associated with at least one of a plurality of character attributes;

(c) receive data representing a player selection of an unlocked game from a plurality of different games, wherein a plurality of said games are initially unlocked, at least one of the games is initially locked, and each of the games is associated with at least one of a plurality of game attributes;

(d) for a play of the selected game:

(i) determine a game outcome, (ii) cause at least one display device to display the determined game outcome, (iii) determine any award associated with the determined game outcome, and (iv) cause the at least one display device to display any determined award, wherein the credit balance is increasable based on any determined award;

(e) if a bonus game triggering event occurs:

(i)cause the at least one display device to display a quantity of free games, wherein the quantity of free games is determined based on the at least one character attribute of the selected character and the at least one game attribute of the selected game;

(ii) if a character unlock event occurs in association with at least one of the free games, unlock at least one of any locked characters, and (iii) if a game unlock event occurs in association with at least one of the free games, unlock at least one of any locked games; and (f) if data associated with receipt of a cashout input via a cashout device is received, cause an initiation of any payout associated with the credit balance.

13. The gaming system server of claim 12, wherein when executed by the at least one processor if the character unlock event occurs in association with at least one of the free games, the plurality of instructions cause the at least one processor to receive data representing a player selection of the unlocked character for another play of the selected game.

14. The gaming system server of claim 12, wherein when executed by the at least one processor if the game unlock event occurs in association with at least one of the free games, the plurality of instructions cause the at least one processor to receive data representing a player selection to play said unlocked game.

15. The gaming system server of claim 12, wherein when executed by the at least one processor if the character unlock event occurs in association with at least one of the free games and if the game unlock event occurs in association with at least one of the free games, the plurality of instructions cause the at least one processor to receive data representing a player selection of the unlocked character and a player selection to play said unlocked game.

16. The gaming system server of claim 12, wherein when executed by the at least one processor if the bonus game triggering event occurs, the plurality of instructions cause the at least one processor to, for each of the displayed quantity of free games: (i) determine a free game outcome, (ii) cause the at least one display device to display the determined free game outcome, (iii) determine any free game award associated with the determined free game outcome, and (iv) cause the at least one display device to display any determined free game award.

17. The gaming system server of claim 12, wherein when executed by the at least one processor, the plurality of instructions cause the at least one processor to determine if the character unlock event occurs based on the at least one character attribute of the selected character and the at least one game attribute of the selected game.

18. The gaming system server of claim 12, wherein when executed by the at least one processor, the plurality of instructions cause the at least one processor to determine if the game unlock event occurs based on the at least one character attribute of the selected character and the at least one game attribute of the selected game.

19. The gaming system server of claim 12, wherein when executed by the at least one processor, the plurality of instructions cause the at least one processor to determine the quantity of free games based on at least one random determination associated with at least one of the free games.

20. The gaming system server of claim 12, wherein when executed by the at least one processor, the plurality of instructions cause the at least one processor to save, in association with the player, data representing which of any characters are unlocked, which of any characters are locked, which of any games are unlocked and which of any games are locked.

21. The gaming system server of claim 12, wherein the quantity of free games include a plurality of free activations of the selected game.

22. The gaming system server of claim 12, wherein at least one of any determined award is at least one selected from the group of: a quantity of monetary credits, a quantity of non-monetary credits, a quantity of promotional credits, and a quantity of player tracking points.

23. The gaming system server of claim 12, which transmits and receives data over a data network.

24. The gaming system server of claim 23, wherein the data network is an internet.

* * * * *